United States Patent [19]

Wu

[11] Patent Number: 4,934,395

[45] Date of Patent: Jun. 19, 1990

[54] SHORT FOLD RIB LINKAGE FOR AN UMBRELLA

[75] Inventor: Tsun-Zong Wu, Taipei, Taiwan

[73] Assignees: 'totes', incorporated; Fu Tai Umbrella Works, both of Loveland, Ohio

[21] Appl. No.: 250,756

[22] Filed: Sep. 28, 1988

[51] Int. Cl.[5] ..... A45B 19/00

[52] U.S. Cl. ..... 135/25 R

[58] Field of Search ..... 135/25 R, 25 A, 26

[56] References Cited

U.S. PATENT DOCUMENTS

| | | |
|---|---|---|
| 419,325 | 1/1890 | Flint . |
| 472,457 | 4/1892 | Hayes et al. . |
| 580,159 | 4/1897 | Ladewig . |
| 872,518 | 12/1907 | Johnson . |
| 1,049,360 | 1/1913 | Hoffman . |
| 1,249,007 | 12/1917 | Block . |
| 1,264,010 | 4/1918 | Calusinski . |
| 1,474,821 | 11/1923 | Hartzell . |
| 1,577,356 | 3/1926 | Pallone . |
| 1,991,385 | 2/1935 | Geisel . |
| 2,215,738 | 9/1940 | Kohler . |
| 2,616,439 | 11/1952 | Thompson . |
| 2,761,461 | 9/1956 | Mappin et al. . |
| 2,889,841 | 6/1959 | Kampf . |
| 3,677,274 | 7/1972 | Yasuda et al. . |
| 3,732,882 | 5/1973 | Kida et al. . |
| 3,853,136 | 12/1974 | Schwartzenberg . |
| 3,901,257 | 4/1975 | Schafer . |
| 3,921,655 | 11/1975 | Weber . |
| 4,007,752 | 2/1977 | Weber . |
| 4,077,420 | 3/1978 | Schultes et al. . |
| 4,077,421 | 3/1978 | Schultes et al. . |
| 4,080,976 | 3/1978 | Hirai . |
| 4,105,039 | 8/1978 | Schultes et al. . |
| 4,627,455 | 12/1986 | Okuda et al. . |
| 4,658,844 | 4/1987 | Ping . |

FOREIGN PATENT DOCUMENTS

| | | | |
|---|---|---|---|
| 56062 | 3/1943 | Austria . | |
| 181977 | 5/1986 | European Pat. Off. | 135/25 R |
| 812693 | 1/1951 | Fed. Rep. of Germany . | |
| 2352593 | 4/1975 | Fed. Rep. of Germany . | |
| 847608 | 10/1939 | France . | |
| 2392623 | 12/1978 | France . | |
| 436510 | 12/1947 | Italy | 135/25 R |
| 3623507 | 9/1967 | Japan . | |
| 57-7292 | 2/1981 | Japan . | |
| 58-21316 | 2/1983 | Japan . | |
| 6022802 | 2/1983 | Japan . | |
| 6030203 | 3/1983 | Japan . | |
| 58-129810 | 9/1983 | Japan . | |
| 58-129811 | 9/1983 | Japan . | |
| 60-3481 | 4/1984 | Japan . | |
| 60-3482 | 8/1984 | Japan . | |
| 59-120912 | 8/1984 | Japan . | |
| 59-154120 | 10/1984 | Japan . | |
| 59-154121 | 10/1984 | Japan . | |
| 61-37815 | 3/1986 | Japan . | |
| 1094607 | 5/1984 | U.S.S.R. . | |
| 1412639 | 11/1975 | United Kingdom . | |
| 1499737 | 2/1978 | United Kingdom . | |
| 2179855 | 6/1985 | United Kingdom . | |

*Primary Examiner*—Henry E. Raduazo

*Attorney, Agent, or Firm*—Wood, Herron & Evans

[57] ABSTRACT

A collapsible umbrella with a three primary rib section type rib linkage system. A first feature of the rib linkage is that a stretcher rib, a control link, a center rib, and a control strut cooperate to define a rib linkage with a profile opening of generally quadrilateral configuration above the stretcher rib when the umbrella is held upright and the rib linkage is between full opened and full closed positions. A second feature is that the stretcher rib is comprised of an inner section, an outer section, and an offset section connecting the inner and outer sections. The offset section is sized and configured so that the inner section provides partial support for the umbrella's cover when the umbrella is opened. A third feature of the system is that a seat is defined in the underside of the control link, and a bend section is provided at the outer end of the stretcher rib, that bend section permitting the outer end of the stretcher rib and the inner end of the center rib to be at least partially received within the control link seat when the umbrella is opened to enhance structural stability of the open rib linkage system.

9 Claims, 2 Drawing Sheets

SHORT FOLD RIB LINKAGE FOR AN UMBRELLA

This invention relates to umbrellas. More particularly, this invention relates to an improved umbrella rib linkage system, and to an umbrella that incorporates that improved rib linkage system.

There are two basic types of umbrellas, namely, stick umbrellas and collapsible umbrellas. In a stick umbrella, the umbrella centerpost is of a single fixed or non-collapsible length. In a collapsible umbrella, on the other hand, the umbrella centerpost is composed of two or more sections that can telescope one within the other in order to shorten the centerpost length and, thereby, shorten the umbrella itself, when it is in the collapsed or storage position. Collapsible umbrellas have been well received in the marketplace in recent years because they are so easy to store and to carry by their owners. A collapsible umbrella can be carried in a briefcase or handbag or the like so it is always available for use if the need arises, whereas a stick umbrella is normally only carried when the weather makes it appear that its use will be necessary.

A rib linkage system for a collapsible umbrella must permit an overall umbrella length that is reasonably short in the storage or full closed position, and must permit an umbrella cross-sectional area that is reasonably small in the storage or full closed position, relative to the umbrella's full opened or use position, so the umbrella can be easily stored or carried whenever and wherever desired by the user. More particularly, a collapsible umbrella must be relatively short, and must have a relatively small cross-sectional area, i.e., must be compact, when it is collapsed for storage, but it must also be of normal size when it is opened for use. In other words, it is desirable to maintain as large a radius as possible for the umbrella's cover when the umbrella is full opened, while providing a rib linkage system that permits the centerpost and rib linkages, as well as the cover, to be retracted to a desirably short overall length, and to a desirably small cross sectional area, when it is the storage or full collapsed position. But in meeting these overall objectives, it is also necessary that the umbrella's rib linkage system provide optimum support to the cover when the umbrella is opened, be relatively strong so as to withstand wind forces to which the umbrella may be subjected during use, and be relatively easy to operate and smooth in its operation for its owner.

Accordingly, it has been a primary objective of this invention to provide an improved short fold rib linkage system for a collapsible umbrella where the collapsed length of the umbrella is relatively short, and where the cross-sectional area of the collapsed umbrella is relatively small, in order to provide an umbrella that can be easily carried and stored by its owner, yet can be easily opened and closed by its owner, and which also provides adequate weather protection when full opened.

In accord with this objective, the improved short fold rib linkage system of this invention is of the three rib section type. A first feature of the rib linkage is that a stretcher rib, a control link, a center rib, and a control strut cooperate to define a rib linkage with a profile opening of generally quadrilateral configuration above the stretcher rib when the umbrella is held upright and the rib linkage is between full opened and full closed positions. A second feature is that the stretcher rib is comprised of an inner section, an outer section, and an offset section connecting the inner and outer sections, the offset section being sized and configured so that the inner section provides partial support for the umbrella's cover when the umbrella is opened. A third feature includes a seat defined in the underside of the control link, and a bend section at the outer end of the stretcher rib, that bend section permitting the outer end of the stretcher rib and the inner end of the center rib to be at least partially received within the control link seat when the umbrella is opened to enhance structural stability of the open rib linkage system.

Other objectives and advantages of this invention will be more apparent from the following detailed description of the invention taken in conjunction with the drawings in which.

Figure 1:
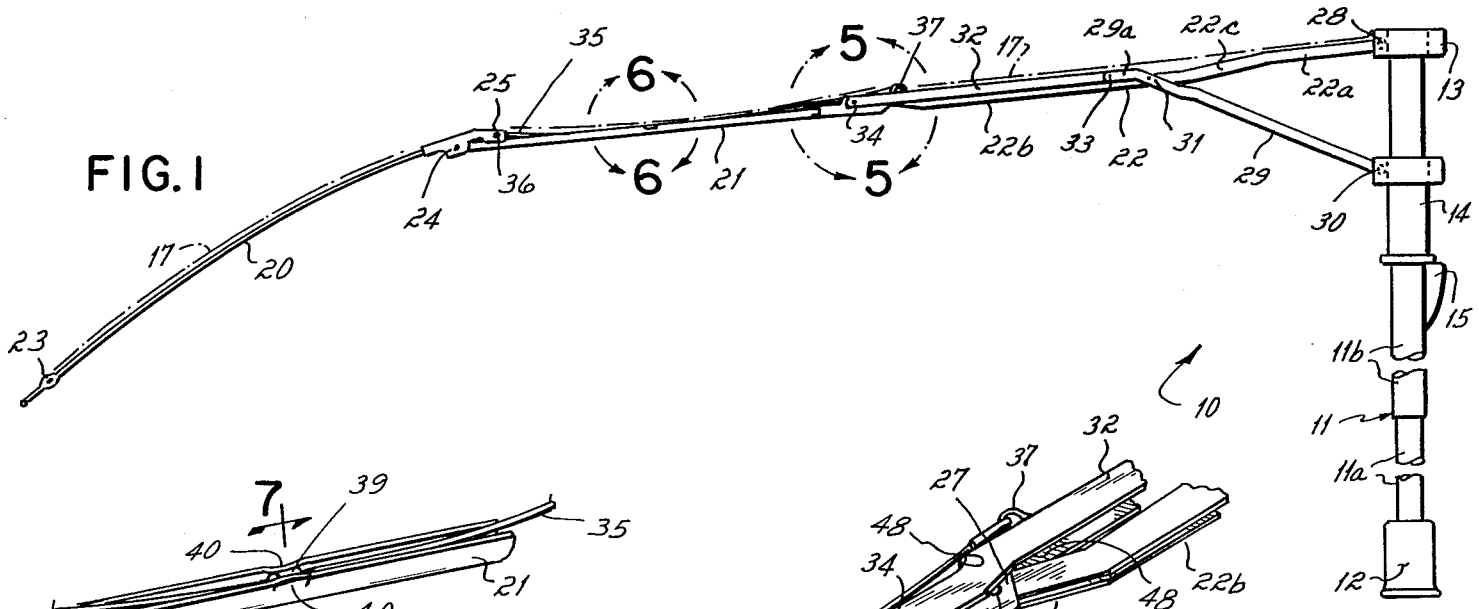
FIG. 1 is a side view of an umbrella in accord with the principles of this invention, the umbrella being shown in the fully opened position.

An umbrella 10 in accord with the principles of this invention is of the collapsible type. The umbrella basically includes a centerpost 11 having sections **11*a* and 11*b* that are telescopeable one to the other. A handle 12 is provided at the base end of the centerpost, and a crown 13 at the top end of the centerpost. A runner 14 is slideably carried on the centerpost, the runner being held in the umbrella open position by a spring loaded latch 15 carried by the centerpost 11. The short fold rib linkage system 16 in accord with the principles of this invention is connected to the centerpost 11 via the crown 13 and the runner 14, and is for the purpose of supporting cover 17 in an open dome-shaped configuration when the umbrella is fully opened in use position. The short fold rib linkage system 16 of this invention is of the three rib section type, those primary rib sections comprising cover rib 20, center rib 21 and stretcher rib 22** in this particular rib linkage system.

Figure 4:
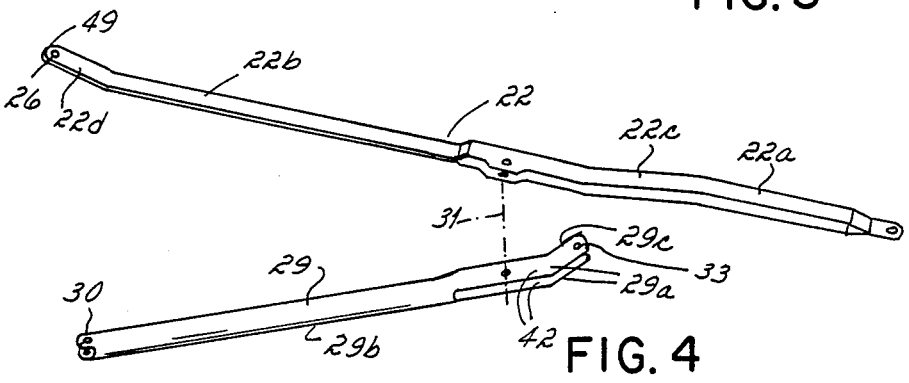
FIG. 4 is an exploded perspective view illustrating two specific components of the rib linkage system.

The rib linkage system 16 includes semi-flexible cover rib 20 to which the cover 17 is connected as at 23 at its outer end. The rigid center rib 21 is pivotally connected as at 24 at its outer end to the cover rib 20, the center rib being 21 connected to the cover rib 20 at that point 24 which is adjacent to but spaced from the inner end 25 of the cover rib. The rigid stretcher rib 22 is pivotally connected as at 26 at its outer end to the center rib 21 at the inner end 27 of the center rib, and is pivotally connected as at 28 at its inner end to the crown 13 at the top end of the centerpost. A rigid control strut 29 is pivotally connected as at 30 at its inner end to the runner, and is pivotally connected midway between its ends as at 31 to the stretcher rib 22. Note particularly, as shown in FIG. 4, the control strut 29 is comprised of a fork section **29*a* that defines the outer section of that control strut. The fork section 29*a* is composed of opposed arms 42 spaced one from the other, and extending beyond the U-shaped main section 29*b* of the control strut 29**.

Figure 2:
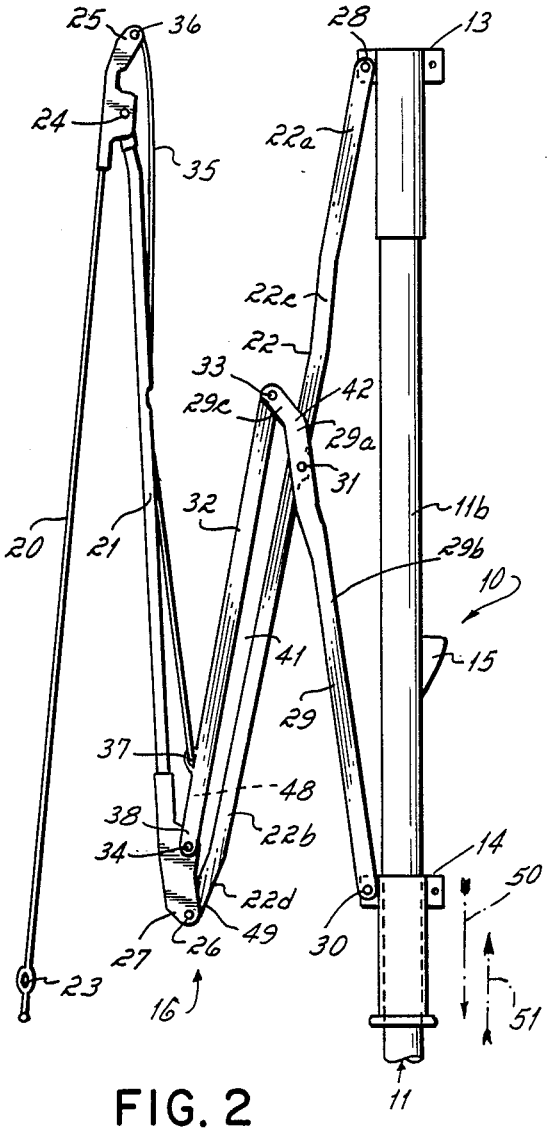
FIG. 2 is a side view similar to FIG. 1 but showing the umbrella in an intermediate open position.
Figure 3:
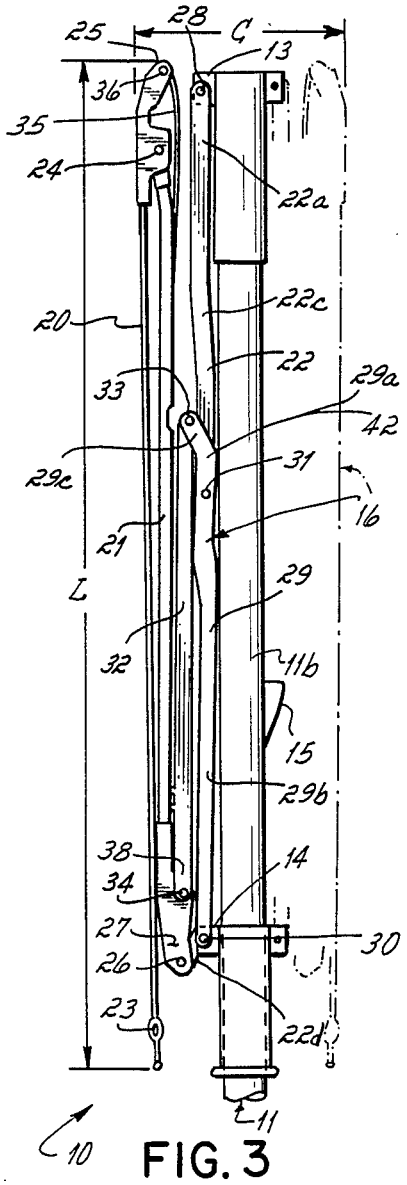
FIG. 3 is a side view similar to FIGS. 1 and 2 but showing the umbrella in a fully closed position.

A rigid control link 32 is pivotally connected as at 33 at its inner end to the outer end of the control strut, and is pivotally connected as at 34 to the center rib 21 at the outer end of the control link, that pivotal connection 34 being located adjacent to but spaced from the inner end 27 of the center rib. The control link 32 and the stretcher rib 22 are both pivotally connected to the control strut 29 within its fork section 29*a* so that same are freely pivotable relative to other components of the rib linkage system 16 to that extent necessary in order to permit the rib linkage system to move between fully opened and closed positions. A flexible tension link 35 is pivotally connected as at 36 at its outer end to the inner end 25 of the cover rib 20, and is pivotally connected as at 37 at its inner end to the control link 32, that pivotal connection 37 being located adjacent to but spaced from the outer end 38 of the control link. Note the flexible tension link 35 is oriented above the center rib 21 when the umbrella is held upright. Also, the flexible tension link 35 is slideably received in a sleeve 39 fixed to the center rib 21 approximately midway between the ends of that center rib. The sleeve 39 is clamped in fixed position relative to the center rib 21 by fingers 40 crimped out of the center rib. All of the center rib 21, control link 32, stretcher rib 22 and control strut 29 are basically channel shaped configuration, and are rigid or non-flexible. The flexible tension link 35 is of springwire to allow it to flex substantially as the rib linkage system moves between the fully opened FIG. 1 and fully closed FIG. 3 positions. The cover rib 20 is also a wire rib, and is semi-flexible (compare FIGS. 1 and 3) to aid in drawing the cover 17 tight over the rib linkage system 16 when the umbrella is fully opened. Note particularly, as illustrated in FIG. 2, that the stretcher rib 22, control link 32, center rib 21, and control strut 29 cooperate to define a rib linkage system with a profile opening 41 of generally quadrilateral configuration, that opening 41 being positioned above the stretcher rib when the umbrella is held upright and the rib linkage is between full opened and closed positions. The fact that this quadrilateral rib 21, 22, link 32 and strut 29 configuration is oriented above the stretcher rib 22 enhances the compactness, both as to shortness of overall length L as well as to smallness of cross-sectional area C, when the umbrella is in the collapsed configuration as shown in FIG. 3.

The stretcher rib 22 employed in this short fold rib linkage system 16 of the three rib section 20–22 type is of a novel configuration. Note particularly the stretcher rib 22 includes an inner section 22*a* and an outer section 22*b*, which are generally parallel one to the other, and an offset section 22*c* which connects those inner and outer sections of the stretcher rib. As is particularly shown in FIG. 1, the offset section 22*c* is sized and configured so that the stretcher rib's inner section 22*a* provides partial support for the cover 17 when the umbrella is opened. This for the reason that the stretcher rib's inner section 22*a* and the control link 32 are generally aligned end to end when the umbrella is opened so that both those components provide partial support for the cover 17 when the umbrella is fully opened, thereby causing the cover to be smoothly stretched over the rib section 22*a* and link 32. Note also, as shown in FIG. 3, that the stretcher rib's offset section 22*c* permits the stretcher rib's outer section 22*b* to fold closely adjacent the umbrella's centerpost 11 when the umbrella is collapsed, thereby allowing the control strut 29 to abut the centerpost when the umbrella is collapsed. This stretcher rib's offset section 22*c*, therefor, also enhances the smallness of the umbrella's cross-sectional area C when the rib linkage system 16 is collapsed because it permits the entire rib linkage system to be folded that much more closely to and compactly against the umbrella centerpost. These functions are particularly accommodated because the stretcher rib's offset section 22*c* is positioned in the stretcher rib 22 between the stretcher rib's pivot connection 28 with the centerpost's crown 13 and the stretcher rib's pivot connection 31 with the control strut 29. Note also that the control strut 29 includes a bend section 29*c* at the outer end of that control strut. The control strut's bend section 29*c* bends outwardly away from the centerpost 11 when the umbrella is held upright, and the control link 32 is pivotally connected to the outer end of that bend section. As particularly shown in FIG. 1, the bend section 29*c* of the control strut 29 also is generally aligned between, and end to end with, the stretcher rib's inner section 22*a* and the control link 32 so that all three of these components provide partial support for the cover 17 when the umbrella is fully opened in order to enhance the smoothness of the cover over the rib linkage system 16.

Figure 5:
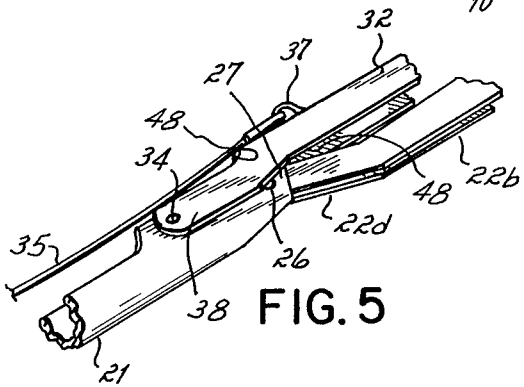
FIG. 5 is an enlarged perspective view illustrating the encircled area 5—5 of FIG. 1.
Figure 6:
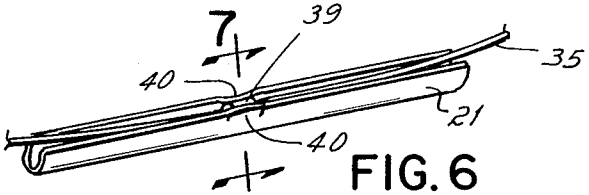
FIG. 6 is an enlarged perspective area illustrating a second encircled area 6—6 of FIG. 1.
Figure 7:
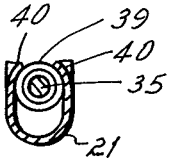
FIG. 7 is a cross section taken along lines 7—7 of FIG. 6.

The stability of the rib linkage system 16 when the umbrella is fully opened is enhanced by the interaction of the center rib 21, the stretcher rib 22, and the control link 32 as particularly illustrated in FIG. 5. The control link 32, being of a generally inverted U-shaped configuration, defines a seat 48 or recess on its underside. A bend section 22*d* is provided at the outer end of the stretcher rib 22, and is directed relatively upwardly when the umbrella is opened. The center rib 21 is connected to the stretcher rib 22 at the outer end of the stretcher rib's bend section 22*d*. The stretcher rib's bend section 22*d*, when the umbrella is fully opened as illustrated in FIG. 1, causes the outer end 49 of the stretcher rib and the inner end 27 of the center rib 21 to be at least partially received within the seat 48 defined by the control link 32. This enhances the structural stability of the open rib linkage system 16 relative to wind induced forces on the umbrella such as might otherwise tend to sway or bend the rib linkages when the umbrella is in use.

In use, the umbrella is opened and closed simply by moving the runner 14 up or down the umbrella's centerpost 11. Specifically, and in order to collapse the umbrella from the FIG. 1 position to the FIG. 3 position, the runner 14 is drawn downwardly as shown by phantom arrow 50. This causes the rib linkage system 16 to translate from the FIG. 1 fully opened position through the FIG. 2 intermediate position into the FIG. 3 fully collapsed position. In the FIG. 3 fully collapsed position, as previously noted, the stretcher rib's offset section 22*c* cooperates with the other links and ribs of the rib linkage system 16 so as to minimize the cross-sectional area C of the rib linkage system in the collapsed position. Further, and since the control link 32 and flexible tension link 35 are located above the stretcher rib 22 and center rib 21, respectively this enhances the shortness of length of the umbrella in the collapsed position. In order to erect the umbrella, the runner 14 is moved in a direction shown by phantom arrow 51 up the centerpost 11 until it is held in spaced relation from the crown 13 by the spring-loaded latch 15. In this position, the stretcher rib's offset section 22*c*, the control strut's outer bend section 29*a*, and the control link 32 all are generally aligned one with the other in order to provide a relatively smooth surface over which the cover 17 is stretched in order to enhance the appearance and usability of the umbrella. In this erected condition, the seating of the stretcher rib's outer bend section **22*d* and the center rib's inner end 27 within the control link's seat 48** enhances the structural stability of the rib linkage system if the fully opened umbrella is exposed to wind forces.

Having described in detail the preferred embodiment of my invention, what I desire to claim and protect by Letters Patent is:

1. An umbrella with the three rib section type rib linkage system, sad umbrella comprising a centerpost having a runner slideable thereon, a cover rib to which a cover is connected, a center rib pivotally connected at its outer end of said cover rib, a stretcher rib pivotally connected at its outer end to said center rib at the inner end of said center rib, and pivotally connected at its inner end to the top end of said centerpost, a control strut pivotally connected at its inner end to said runner, and pivotally connected midway between its ends to said stretcher rib, a control link pivotally connected at its inner end to the outer end of said control strut, and pivotally connected toward its outer end to said center rib at a point adjacent to but spaced from the inner end of said center rib, said control link being oriented generally above said stretcher rib when said umbrella is held upright in a fully opened position, and a flexible tension link pivotally connected at its outer end to said cover rib, and pivotally connected at its inner end to said control link, said flexible tension link being oriented generally above said center rib when said umbrella is held upright in a fully opened position, said center rib being connected to said cover rib at a point adjacent to but spaced from the inner end of said cover rib, said control link being connected to said center rib at the outer end of said control link, and said flexible tension link being connected at one end to the inner end of said cover rib and at the other end to said control link at a point adjacent to but spaced from the outer end of said control link, and said stretcher rib, control link, center rib, and control strut cooperating to define a rib linkage with a profile opening of generally quadrilateral configuration above said stretcher rib when said umbrella is held upright and said rib linkage is between fully opened and fully closed positions.

2. An umbrella as set forth in claim 1, said control strut comprising a fork section defining one part of said control strut, both said control link and said stretcher rib being connected to said fork section.

3. An umbrella as set forth in claim 1, said stretcher rib comprising an inner section, an outer section, and an offset section connecting said inner and outer sections, said offset section being sized and configured so that said control strut may abut said centerpost when said umbrella is fully closed.

4. An umbrella with the three rib section type rib linkage system, said umbrella comprising a centerpost having a runner slideable thereon, a cover rib to which a cover is connected, a center rib pivotally connected at its outer end to said cover rib, a stretcher rib pivotally connected at its outer end to said center rib at the inner end of said center rib, and pivotally connected at its inner end to the top end of said centerpost, said stretcher rib comprising an inner section, an outer section, and an offset section connecting said inner and outer sections, said offset section being sized and configured so that said inner section provides partial support for said cover when said umbrella is opened, a control strut pivotally connected at is inner end to said runner, and pivotally connected midway between its ends to said stretcher rib, a control link pivotally connected at its inner end to the outer end of said control strut, and pivotally connected toward its outer end to said center rib at a point adjacent to but spaced from the inner end of said center rib, and a flexible tension link pivotally connected at its outer end to said cover rib, and pivotally connected at its inner end to said control link, said stretcher rib, control link, center rib, and control strut cooperating to define a rib linkage with a profile opening of generally quadrilateral configuration above said stretcher rib when said umbrella is held upright and said rib linkage is between fully opened and fully closed positions.

5. An umbrella as set forth in claim 4, said stretcher rib's inner section and said control link being generally aligned end to end when said umbrella is opened so that both said components provide partial support for said cover when said umbrella is fully opened.

6. An umbrella as set forth in claim 5, said control strut comprising a bend section at the outer end of said control strut, said control link being pivotally connected to said bend section, said bend section being generally aligned between, and generally end to end with, said stretcher rib's inner section and said control link so that all three said components provide partial support for said cover when said umbrella is opened.

7. An umbrella as set forth in claim 4, said offset section being positioned in said stretcher rib between the stretcher rib's connection with said centerpost and the stretcher rib's connection with said control strut.

8. An umbrella with the three rib section type rib linkage system, said umbrella comprising a centerpost having a runner slideable thereon, a cover rib to which a cover is connected, a center rib pivotally connected at its outer end to said cover rib, a stretcher rib pivotally connected at its outer end to said center rib at the inner end of said center rib, and pivotally connected at its inner end to the top end of said centerpost, a control strut pivotally connected at is inner end to said runner, and pivotally connected midway between its ends to said stretcher rib, a control link pivotally connected at its inner end to the outer end of said control strut, and pivotally connected toward its outer end to said center rib at a point adjacent to but spaced from the inner end of said center rib, a flexible tension link pivotally connected at its outer end to said cover rib, and pivotally connected at its inner end to said control link, said stretcher rib, control link, center rib, and control strut cooperating to define a rib linkage with a profile opening of generally quadrilateral configuration above said stretcher rib when said umbrella is held upright and said rib linkage is between fully opened and fully closed positions, a seat defined in the underside of said control link, and a bend section at one of the outer end of said stretcher rib and the inner end of said center rib, said stretcher rib's outer end and said center rib's inner end being connected at said bend section, said bend section permitting the outer end of said stretcher rib and the inner end of said center rib to be at least partially received within said seat when said umbrella is fully opened to enhance the structural stability of the fully opened rib linkage system.

9. An umbrella as set forth in claim 8, said bend section being at the outer end of said stretcher rib.

* * * * *

UNITED STATES PATENT AND TRADEMARK OFFICE

CERTIFICATE OF CORRECTION

PATENT NO. : 4,934,395

DATED : June 19, 1990

INVENTOR(S) : Tsun-Zong Wu

It is certified that error appears in the above-identified patent and that said Letters Patent is hereby corrected as shown below:

Column 5, line 12, delete "sad" and insert -- said -- .

Column 5, line 15, delete "of" and insert -- to -- .

Signed and Sealed this

Fourth Day of August, 1992

*Attest:*

DOUGLAS B. COMER

*Attesting Officer*

*Acting Commissioner of Patents and Trademarks*